United States Patent [19]

Phelps

[11] 4,161,818

[45] Jul. 24, 1979

[54] FOLDING POCKET KNIFE HAVING REPLACEABLE BLADES

[75] Inventor: Paul S. Phelps, Maryville, Tenn.

[73] Assignee: Star Sales Company, Knoxville, Tenn.

[21] Appl. No.: 875,579

[22] Filed: Feb. 6, 1978

[51] Int. Cl.[2] ..... B26B 1/04; B26B 5/00

[52] U.S. Cl. ..... 30/157

[58] Field of Search ..... 30/156, 157, 161

[56] References Cited

U.S. PATENT DOCUMENTS

| | | | |
|---|---|---|---|
| 530,788 | 12/1894 | Moritz | 30/157 |
| 4,040,181 | 8/1977 | Johnson | 30/161 |

FOREIGN PATENT DOCUMENTS

| | | | |
|---|---|---|---|
| 227823 | 6/1925 | United Kingdom | 30/157 |
| 369388 | 3/1932 | United Kingdom | 30/157 |

*Primary Examiner*—Jimmy C. Peters

*Attorney, Agent, or Firm*—Pitts & Kesterson

[57] ABSTRACT

A folding pocket knife which can be readily disassembled for cleaning and blade replacement. The pocket knife comprises a case having first and further cooperating case members. A blade is pivotally mounted at one end portion of the case on a pivot pin which assists in securing the case members together. A spring assembly serves to secure the portions of the case members opposite the case end carrying the blade and applies biasing forces to the blade tang which assists in maintaining the blade in its opened or closed position after being moved to one of such positions by an operator.

7 Claims, 3 Drawing Figures

FOLDING POCKET KNIFE HAVING REPLACEABLE BLADES

This invention relates to pocket knives and more particularly concerns a pocket knife which can be disassembled for purposes of substituting blades and/or cleaning.

Pocket knives having interchangeable blades have been known in the art for quite some time. Typically, the pocket knives have been designed to include a pivot pin which includes at least one end portion which is exposed for purposes of removing the pin to enable replacement of the blade. An example of a pocket knife having a replaceable blade is disclosed in Ludwigsdorf U.S. pat. No. 3,061,927 which utilizes a screw having a shaft which forms the swivel axis for the blade. One end of the screw is threadably received in the jaw at the forward end of the knife case and the opposite end of the screw which includes the screw head, engages the cooperating jaw of the knife.

A drawback to pocket knives having interchangeable blades known in the art is that it is difficult to maneuver the springs into the handle and reassemble the knife subsequent to its being disassembled for cleaning the handle or replacing the blade. Moreover, known prior art handles are typically unitary members which include or define an elongated recess which receives the blade, however, such handles are difficult to clean inasmuch as the handle recesses are substantially inaccessible.

Accordingly, it is an object of the invention to provide a knife which can be readily disassembled and reassembled. Another object of the invention is to provide a knife which has interchangeable blades. A further object of the invention is to provide a folding knife which employs a pivot pin about which the knife blade rotates which has its opposite ends covered when the knife is placed in the assembled condition. A still further object of the invention is to provide a pocket knife which can be disassembled and which employs a spring mount as the member which assists in locking and unlocking the knife parts together. Yet another object of the invention is to provide a knife which can be completely disassembled to facilitate cleaning the knife. Other objects and advantages of the present invention will become apparent upon reading the detailed description together with the drawings in which:

Figure 1:
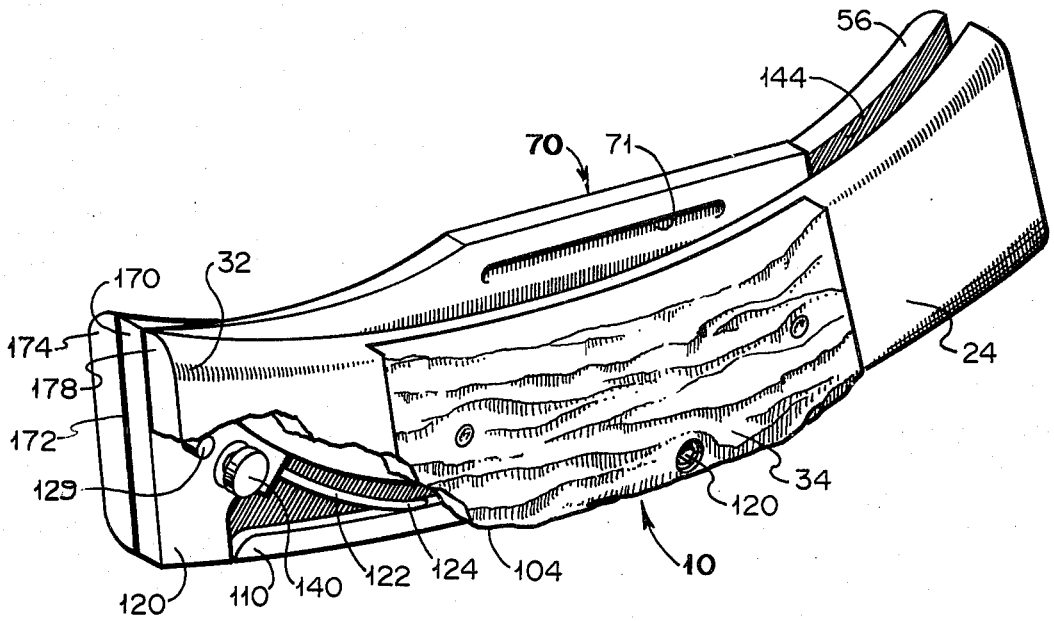
FIG. 1 is a knife constructed in accordance with various features of the invention shown in the closed position.

A folding knife constructed in accordance with various features of the invention is provided which has interchangeable blades and can be readily disassembled for purposes of cleaning. The knife includes a case which comprises a pair of cooperating case members. A blade is pivotally mounted at one of its ends in the case between the cooperating case members. In one embodiment the blade is pivotally mounted in the case by a pivot pin member which is received at its opposite end portions in one set of opposed end portions of the case members. A spring assembly carried by the case serves to assist in securing the first and further case members together. Moreover, the spring assembly engages the end of the blade pivotally mounted in the case and maintains the blade in its open and closed positions upon movement of the blade to these positions by an operator.

Referring now to the figures, the illustrated folding knife generally indicated at 10 includes a case 12 which comprises a pair of cooperating and elongated case members 14 and 16 respectively. The illustrated case member 14 includes an elongated liner 18 which defines a substantially planar inner surface 20 which is positioned proximate the blade when the case is in the assembled condition and the blade is folded within the case. The case member 14 includes a first end portion 22 that carries a bolster 24 which serves to strengthen the end of the case. A slot 26 is defined by the liner 20 and the bolster 24 includes a substantially circular section and a further section having a reduced cross section.

The opposite end portion 30 of the case member 14 is strengthen by a further bolster 32. The end portion 30 of the case member together with the bolster 32 define a further slot 34 which includes a substantially circular section in the illustrated embodiment which is joined with a slot section opening of reduced diameter.

An elongated hafting or handle 35 is secured on the case member 14 on the surface of the case member opposite the surface 20 and covers the liner 18. More specifically, the handle 35 is fabricated from a suitable rigid or semirigid material such as bone, plastic, wood, micarta or the like which preferably has a rough outer surface to facilitate gripping the knife. This handle is secured to the case member 18 by suitable rivets 36 and 38, for example. The handle is proportioned for being received within the space between the end portions 40 and 42 of the bolsters 24 and 32, respectively. The end portions 44 and 46 of the handle 35 abut the end portions 40 and 42, respectively, of the bolsters 24 and 32 such that there is little, if any, spacing between the end portions of the handle and the bolsters which enhances the ability of the handle to strengthen the case.

The case 12 includes a further case member 16 which cooperates with the case member 14 for pruposes of holding and receiving the knife blade. The case member 16 is substantially similar to the case member 14 and the liner surface 50 of the case member 16 is substantially a mirror image of the opposed surface 20 of the case member 14. More specifically, the case member 16 includes an elongated liner 52 which defines the substantially planar inner surface 50 which is positioned proximate the blade when the case is assembled and the blade is folded within the case recess generally indicated at 18 in FIG. 1. The case member 16 includes a first end portion 54 which carries a bolster 56 for purposes of strengthening the case. This bolster can be mounted thereon by suitable rivets 58 and 59, for example. A slot 60 is defined by the liner 52 and the bolster 56. The slot 60 includes a substantially circular section and a further section of reduced cross section. The slot 60 registers with the slot 26 upon placing the case member 14 opposite the case member 16 such that the liners 18 and 52 of the case members 14 and 16, respectively, are opposed. (See FIG. 2) Moreover, when the case members 14 and 16 are placed in this position, the slots 26 and 60 are substantially mirror images of each other.

The opposite end portion 64 of the case member 16 is strengthened by a further bolster 66. A further slot 68 is defined in the end portion 64 of the case member by the liner 52 and the bolster 66. This slot 68 includes a substantially circular section and a further section of reduced cross section. Upon positioning the case member 14 and the case member 16 opposite each other such that the slots 60 and 26 register, the slots 34 and 68 also register for purposes of assemblying the case member as will be described in greater detail hereinafter.

Figure 2:
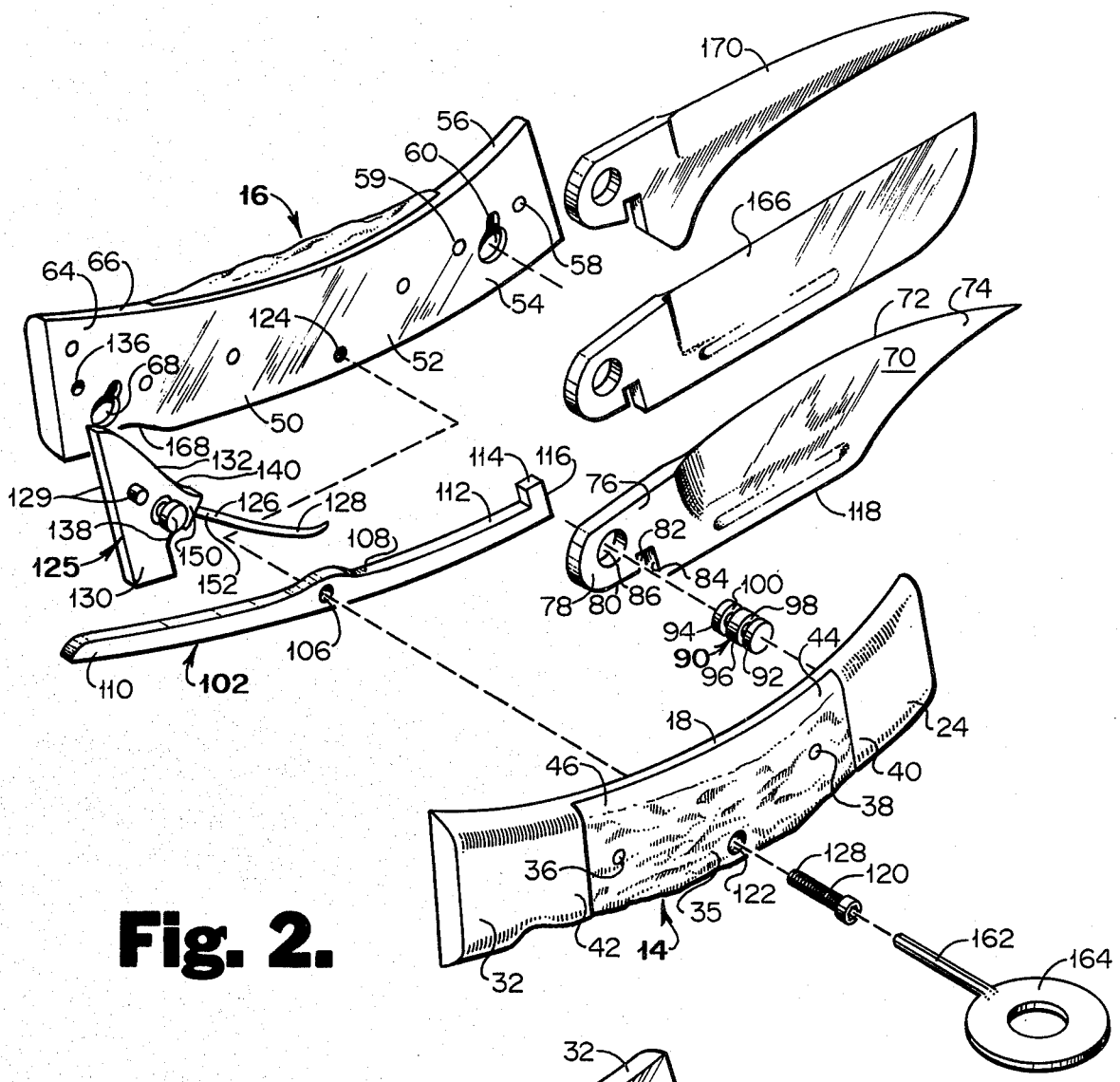
FIG. 2 is an exploded view of the knife shown in FIG. 1 and illustrates various examples of blades which can be mounted in the knife case.
Figure 3:
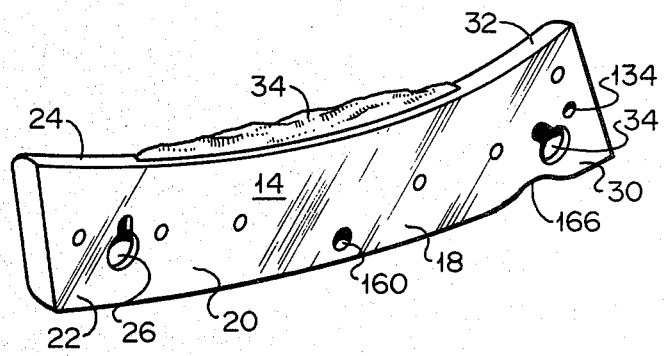
FIG. 3 is a perspective view of one of the case members shown in FIGS. 1 and 2.

One feature of the present invention is to provide a knife having blades which are readily replaceable by an unskilled operator. For example, as illustrated in FIG. 2 the illustrated knife is adapted for receiving blades having various characteristics and adapted for carrying out various cutting operations. The blade 70 which is mounted in the knife shown in FIG. 1, is a general horn shaped blade and defines a cutting edge or swage 72 which is arcuate. This blade 70 includes a first end portion 74 which is pointed and a further end portion 76 which defines a tang 78. The illustrated tang is round, however, it will be recognized by those skilled in the art that tangs having other shapes, such as a square tang, for example, can be used. The back square portion 80 of the tang 78 terminates in a substantially rectangular notch 82 adjacent the run up portion 84 of the tang for purposes of locking the blade in its open position. The blade 70 as provided with a nail mark 118 is to facilitate opening the blade.

An opening 86 is provided in the end portion 76 of the knife for purposes of pivotally mounting the knife in the case. In this connection, the opening 86 is substantially circular in cross section and adapted for receiving a substantially cylindrical blade pivot pin 90 therein. More specifically, the illustrated blade pivot pin 90 is fabricated from a suitable rigid material such as hardened steel, for example, and includes opposite end portions 92 and 94, respectively which are adapted for being received within the slots 26 and 60, respectively, of the case members 14 and 16. The pivot pin 90 further includes a substantially cylindrical midportion 96 which is proportioned for being rotatably received within the substantially circular opening 86 of the blade 70.

The pin 90 serves as a pivot axis for a blade mounted in the knife and further assists in joining the case members 14 and 16. To this end, the opposite end portions 92 and 94 of the pivot pin define circumferential slots 98 and 100, respectively. In order to mount a blade in the case, the pin 90 is inserted into the opening 86 of the blade until the end portions 92 and 94, respectively, extend on opposite sides of the blade tang. These end portions 92 and 94 of the pin are then inserted into the circular sections of the slots 26 and 60, respectively of the case members. The blade is then moved in an upwardly direction as viewed in FIG. 2 until the slots 98 and 100 mate with the sections of the slots 26 and 60 which are of reduced cross section. Upon moving the pivot pin to this position, it will be recognized that the end portions 92 and 94 of the pivot pin are positioned internally of the slots 26 and 60 defined by the case members 14 and 16, respectively, and disposed behind the section of liner defining the portions of each of the slots having a reduced diameter thereby preventing movement of the pin within a direction perpendicular to the longitudinal axis of the case member slots. The blade is thereby secured between the case members 14 and 16 and can be pivoted about the midportion 96 of the pivot pin.

A spring assembly is provided which assists in securing the first and further case members together and engages the end of the blade pivotally mounted in the case for purposes of maintaining the blade in its opened and closed positions. An elongated spring 102 is interposed between the case members 14 and 16 and disposed proximate the back 104 of the assembled knife. The illustrated spring 102 is fabricated from a suitable semi-rigid material and is generally heat treated to provide a proper biasing effect for the blade. More specifically, the illustrated spring 102 defines an opening 106 at its substantial midportion 108. End portion 110 of the spring is disposed between the end portions 64 and 30 of the case members 16 and 14, respectively, upon assembling the knife. The opposite end portion 112 of the spring carries a locking member 114 which is proportioned for being received in the notch 82 upon moving the blade 70, for example, to its open position. This locking member 114 includes a leading surface 116 which engages the run up 84 of the knife and prevents the knife blade from closing during cutting operations or when applying forces to the back edge 118 of the knife blade.

Upon mounting the spring 102 in the knife case, a threaded member, i.e., the set screw 120 is passed through the opening 122 in the case member 14. This opening 122 registers with the opening 106 in the spring and also the opening 124 in the case member 16. The opening 124 is internally threaded and threadably receives the end portion 128 of the set screw 120 for purposes of joining the case member 14 and the case member 16.

The spring 102 is pivoted about the shaft of set screw 120 upon being secured within the case member such that the end portion 112 of the spring applies forces to the knife tang during the opening and closing operations of the knife blade. In this connection, the end portion 110 of the knife spring 102 is biased outwardly such that the tang of the knife blade carried by the case walks on the end portion 112 of the spring during pivotal movement of the knife blade. To this end, a spring mount 125 serves to support an elongated spring or spring member 126 which includes an end portion 128 that biases the end portion 110 of the spring 102 outwardly. More specifically, the mount 125 is fabricated from a substantially rigid material and includes a pair of studs 129 which are substantially axially aligned and extend perpendicularly outwardly from the opposite surfaces 130 and 132 of the mount. These studs 129 are rotatably received within the openings 134 and 136 of the case members 14 and 16, respectively, for reasons more clearly delineated hereinafter. The opposite substantially planar surfaces 130 and 132 of the mount 125 carry locking pins 138 and 140, respectively. These locking pins are disposed at spaced locations from the studs 129 and are substantially axially aligned. Each of the locking pins 138 and 140 are substantially similar and include cylindrical end portions carried at the outboard end of a stud which is of reduced diameter and connected at one of its ends to the associated surface of the spring mount.

In the illustrated embodiment the side of the mount 125 shown in FIG. 2 is substantially identical to the opposite side of amount, as will be recognized from the above description. It will be recognized, however, that the mount 125 can be pivotally mounted on one of the case members and detachable only from the cooperating case member.

The spring mount 125 carries an elongated spring member 126 which engages the end portion 110 of the elongated spring 102 for purposes of pivoting this sring 102 and biasing the opposite end portion 112 of the spring member 102 against the blade tang. In this connection, the spring mount 125 includes a section 150 which is provided with a recess (not shown) adapted for receiving the end portion 152 of the spring member 126 therein. The spring is secured within the recess as by welding or the like. This spring member 126 is proportioned and carried by the mount such that the end portion 128 of the spring member engages and biases the end portion 110 of the spring member 102 outwardly. To this end, the spring member 126 is fabricated from a semi-rigid material and preferably heat treated to provide the proper biasing effect.

As mentioned more generally hereinabove, the illustrated knife includes a locking mechanism adapted for locking the blade in its open position to assist in preventing inadvertent closing of the knife as during cutting operations which might otherwise cause physical injury to the hand of the operator. In this connection, after the knife blade 70 has been moved to its completely open position which is generally indicated by the position of the blade 70 in FIG. 2, the locking member 114 at the end 112 of the spring 102 snaps into the notch 82 such that the blade 70 cannot be closed. More specifically, the end 110 of spring 102 is pivoted outwardly under the force of the spring 126 and causes end 112 of the spring to be biased against the blade tang as the knife blade is pivoted toward its open position. Upon movement of the notch 82 into register with the member 114, this member 114 is moved into the notch and secures the blade in its open position. In order to intentionally close the blade, the end portion 110 of the spring member 102 can be pressed in toward the knife recess such that the portion 114 of the spring member is pivoted from the notch 82 to enable closing the knife. To facilitate depressing the end 110 of the spring member 102 the bolsters 32 and 66 of the case members 14 and 16, respectively, are provided with arcuate recesses 166 and 168, respectively, which provide ready access to the end portion 110 of the spring member 102.

The knife 10 can be assembled by inserting the pivot pin 90 within an opening 86 of a blade, such as blade 70, and placing the end portion 94 of the pin within the circular section of the slot 60 in the case member 16. The spring mount 125 is then positioned adjacent the liner 52 of the case member 16 such that its stud 129 extends within the opening 136 and the locking pin 140 is received within the circular section of the slot 68 at the end portion 64 of the case member 16. The case member 14 as shown in FIG. 2 can then be moved such that the end portion 92 of the blade pivot pin 90 is received within the circular section of the slot 26 defined by the liner 18 and the bolster 24. As the end portion 92 of the blade pivot pin 90 is received within this slot 26, at the opposite end portion 30 of the case member 14, slot 34 serves to receive the portion of the locking pin 138 on the spring mount 125 and the stud 129 on surface 130 is received within the circular section of opening 134 in the case member 14.

The pair of axially aligned studs and the pair of axially aligned locking pins which extend from the opposite surfaces of the spring mount 125 are disposed at predetermined locations. In this connection, the studs and the locking pins can be moved into register with the openings and slots on the associated case members when the spring 126 is rotated such that it extends beyond the back of the knife. Upon rotation of the end portion 124 of the spring 126 upwardly as shown in FIG. 2 or within the recess defined within the knife case by the case members 14 and 16, the mount 125 is pivoted about its studs 129 which are received within the openings 134 and 136 of the case members 14 and 16, respectively. Moreover, as the spring mount 125 is rotated the head portion of the locking pins 138 and 140 are moved such that these head portions of increased diameter or cross section are pivoted behind the sections of the liner defining the openings of reduced cross sections such that the locking pins are secured into position. The mount 125 includes an end surface 170 which is proportioned for closing the end 172 of the knife 10 as shown in FIG. 1. More specifically, as the mount 125 is rotated in a counter clockwise direction as viewed in FIG. 2, after the studs 129 have been inserted into their respective openings and the locking pins 138 and 140 inserted into their associated circular sections of the slots 34 and 68, respectively, the surface 170 forms a substantially continuous surface with the end surfaces 174 and 178 of the bolsters 66 and 32, respectively. The locking spring 102 is then interposed between the case members 14 and 16 such that its opening 106 is aligned with the openings 124 and 160. In order for these openings to be aligned, the end portions 94 and 92 of the blade pivot pin 90 must be moved upwardly as shown in FIG. 1 such that these end portions come to rest behind the sections of the liners which define the reduced sections of the openings or slots 60 and 26 whereby the blade pivot pin is secured in position.

It will be recognized that the spring member 126 which bias the end portion 110 of the spring outwardly in the assembled knife, tends to resist movement of the spring member 102 into the recess 144 which receives the knife blade when it is moved to its closed position. Thus upon inserting the spring 102 into the back portion of the recess 144 such that its opening 106 registers with the openings 122 and 124 of the case members, force must be exerted against the spring 102 to overcome the biasing force of the member 126. The case members and blade are, however, secure during this step of the assembly inasmuch as the pin 90 and locking studs 138 and 140 have been moved into their locked position.

The set screw 120 is then advanced through the opening 122, the registering opening 106 and threadedly received within the opening 124 defined in the case member 16. To facilitate joining the cooperating case members 14 and 16 with the set screw 120, the screw is provided with a suitable opening which can be engaged by the end portion 162 of the wrench 164.

Similarly, the knife can be disassembled by removing the set screw 120 which releases the spring 102 such that this spring can be removed from the back portion of the knife. The operator can then engage the end portion 128 of the spring member 126 and rotate this member outwardly such that the head portions of the locking pins 138 and 140 are pivoted into register with the substantially circular sections of the slots 34 and 168, respectively. The blade 70 can then be moved downwardly such that the enlarged head portions 94 and 92 of the blade pivot pin 90 moved into register with the substantially circular sections of the slots 60 and 26, respectively. Then, the case member 14 can be lifted away from the cooperating case member and if necessary or desired a new blade such as the blade 166 or blade 160 can be substituted for further cutting operations. Moreover, the knife can be readily disassembled for purposes of cleaning.

From the foregoing detailed description, it will be recognized that the disclosed knife incorporates certain advantages over knives heretofore known in the prior art. For example, the illustrated knife can be readily assembled and disassembled for purposes of cleaning or to substitute blades which are more particularly adapted for the desired cutting function. In this connection, a single threaded screw is employed which joins the cooperating case members to culminate the assembly operation. This set screw also serves as a pivot for the spring 102 of the knife. The blade pivot pin and locking pins of the spring mount are covered when the knife is assembled and cannot be loosened until the set screw joining the cooperating case members is removed from the knife assembly. Thus the members which join the opposite ends of the cooperating case members are not exposed in the assembled knife, and they are locked into position by the associated knife components. To this end, the slots 68 and 34 are substantially mirror images of each other and serve to lock the pins 140 and 138 into position upon rotation of the mount about the studs 129. Likewise, the slots 60 and 26 are mirror images of each other and serve to lock the pin 90 into position. Inasmuch as the knife can be assembled and disassembled in a step by step operation which substantially requires manipulation of a single component of the knife at a time, the knife can be readily assembled and disassembled by a single person.

While a preferred embodiment has been shown and described, it will be understood that there is no intent to limit the invention by such disclosure, but rather it is intended to cover all modifications and alternate constructions falling within the spirit and scope of the invention as defined in the appended claims.

What is claimed is:

1. A pocket knife which can be readily disassembled for purposes of cleaning and substituting blades comprising:

a case including first and further cooperating members which are releasably secured to each other, a blade pivotally mounted at one of its end in said case between said first and further cooperating members, a first spring member, said first spring member being elongated and definng a first end portion and a further end portion, said first spring member defining an opening therethrough between said first and further end portions for pivotally mounting said first spring member between said first and further case members; and a spring mount carried by said case and serving to secure said first and further case members together, said spring mount carrying a further spring member, said further spring member engaging said further end portion of said first elongated spring member, and said first end portion of said elongated spring member engaging said end portion of said blade proximate said opening to assist in maintaining said blade in its opened and closed positions upon movement of said blade to such positions by an operator.

2. The knife of claim 1 wherein said blade is pivotally mounted on a pin member which includes a first and further end portion, said first end portion being releasably secured to said first case member and said further end portion being releasably secured to said further case member.

3. A pocket knife which can be readily disassembled for purposes of cleaning and substituting blades comprising:

a case including first and further cooperating members, each of said first and further members being elongated and having a first and further end portion, a pivot pin including a first end portion which is carried by said first end portion of said first case member when said knife is assembled, and a further end portion which is carried by said first end portion of said further case member when said knife is assembled, a blade including a first end portion, and a further end portion, said further end portion defining a tang and an opening, said opening being proportioned for rotatably receiving the pivot pin for rotatably mounting the blade on said case, a first spring member, said first spring member being elongated and releasably a first end portion and a further end portion, said first spring member defining an opening therethrough between said first and further end portions for pivotally mounting said first spring member between said first and further case members; and a spring mount carried by said case and serving to secure said first and further case members together, said spring mount carrying a further spring member, said further spring member engaging said further end portion of said first elongated spring member, and said first end portion of said elongated spring member engaging said end portion of said blade in its opened and closed positions upon movement of said blade to such positions by an operator.

4. The knife of claim 3 wherein said spring mount is releasably secured to at least one of said case members.

5. The knife of claim 4, wherein said first elongated spring is pivoted about a threaded member which is joined at one of its ends with said first case member, and which is joined at its opposite end with said further case member.

6. A pocket knife assembly which can readily be disassembled for purposes of cleaning and substituting blades comprising:

a case including first and further cooperating members each of said first and further members having a first end portion and a further end portion, each of said first end portions of said first and further members defining a slot, each of said further end portions of said first and further members defining a further slot, a blade including a first end portion and a further end portion, said further end portion defining an opening therethrough, a pin member having first and further end portions which are adapted for being received in said first and further slots respectively, of said first end portion of said case members, said pin member defining a mid portion which is adapted for being rotatably received in said opening defined in said blade, a first spring member, said spring member being elongated and defining a first end portion and further end portion, said spring member defining an opening therethrough at substantially equal distances from the first and further end portions of the spring, and a spring mount interposed between said first and further case members, said spring mount being joined to at least one of said case members, and carrying a further elongated spring member, said further spring member engaging said further end portion of said first elongated spring member whereby said first end of said first elongated spring member engages the end portion of said blade proximate said opening.

7. The pocket knife assembly of claim 6 wherein each of said further end portions of said first and further case members defines an opening positioned at a spaced location from the further slot defined on its further end portion, and said spring mount includes first and further planar surfaces and first and further substantially axially aligned studs, said first stud extending from said first planar surface of said mount and said further stud extending from said further planar surface of said mount, said first stud being pivotally received in said opening in said further end portion of said first case member and said further stud being pivotally received in said opening in said further end portion of said further case member, said spring mount further including first and further substantially axially aligned locking pins, said first locking pin extending from said first planar surface of said mount and said further locking pin extending from said further planar surface of said mount whereby said further end portions of said first and further case members are secured in an assembled position by inserting the first stud and the first locking pin in the opening and slot, respectively, of the further end portion of the first case member and by inserting the further stud and the further locking pin in the opening and slot, respectively of the further end portion of the further case member and thence rotating the mount about the studs until the locking pins move within their respective slots and secure the further end portions of the case members.

* * * * *